US005108865A

United States Patent [19]

Zwaldo et al.

[11] Patent Number: 5,108,865

[45] Date of Patent: Apr. 28, 1992

[54] OFFSET TRANSFER OF TONER IMAGES IN ELECTROGRAPHY

[75] Inventors: Gregory E. Zwaldo; Roger I. Krech; Donald L. Knutson, all of St. Paul, Minn.

[73] Assignee: Minnesota Mining and Manufacturing Company, St. Paul, Minn.

[21] Appl. No.: 510,598

[22] Filed: Apr. 18, 1990

[51] Int. Cl.[5] ..... G03G 13/14

[52] U.S. Cl. ..... 430/126; 430/117

[58] Field of Search ..... 430/126, 117

[56] References Cited

U.S. PATENT DOCUMENTS 3,716,360 2/1973 Fukushima et al. ..... 96/1.4
4,234,644 11/1980 Blake et al. ..... 428/204
4,510,225 4/1985 Kuehnle et al. ..... 430/126
4,542,052 9/1985 Shadbolt et al. ..... 428/40
4,686,163 8/1987 Ng et al. ..... 430/126
4,708,460 11/1987 Langdon ..... 430/126

*Primary Examiner*—John Goodrow
*Attorney, Agent, or Firm*—Gary L. Griswold; Walter N. Kirn; Mark A. Litman

[57] ABSTRACT

An electrographic imaging process is performed by generating an electrostatic image, contacting the image with a temporary receptor sheet comprising a carrier layer, releasable release layer, and transferable adhesive layer secured to said release layer. The image is adhered to the adhesive surface, and that surface with the image thereon is then contacted with a final receiving (receptor) surface. The adhesive layer secures the toner image, adhesive layer, and the release layer (now a top protective layer) to the final receiving surface to generate the final image.

20 Claims, No Drawings

OFFSET TRANSFER OF TONER IMAGES IN ELECTROGRAPHY

BACKGROUND TO THE INVENTION

1. Field of Invention

The invention relates to offset toner transfer of electrographic images and especially successively developed images and most preferably colored images composed by overlaying two or more separate and/or differently colored toned images, the total composite being subsequently transferred from the primary image forming surface to a temporary receptor surface having a conformable adhesive and removable release layer thereon, and then further transferring the image and the adhesive to a permanent receptor surface. In the most general form of the invention the toners differ in color. The invention particularly concerns methods improving the efficiency of the transfer step and the quality of the resulting images.

2. Background of the Art

Multicolor toner images produced by successive toner transfer from a photoconductor to a single receptor are well known in the art both for powder toners with constituents intended to improve resolution on transfer and for use with magnetic brush development (U.S. Pat. No. 3,833,293). U.S. Pat. No. 3,612,677 discloses a machine designed to provide good registration when using successive color image transfer, and U.S. Pat. No. 3,804,619 discloses special powder toners to overcome difficulties toners have in 3 color successive transfer.

The production of multi-colored images by overlaying toned images on a photoconductor surface is also known. Thus U.S. Pat. No. 3,337,340 discloses liquid developers designed to minimize the "bleeding away of charge on the photoconductor surface" which occurs when recharging of an already toned surface is attempted. U.S. Pat. No. 4,155,862 and U.S. Pat. No. 4,157,219 disclose liquid toner formulations and apparatus for producing multicolor composite toned images on a photoconductor surface. U.S. Pat. No. 4,275,136 emphasizes the difficulties in ensuring that overlaid toner layers on a photoconductor adhere to one another. The addition of zinc or aluminum hydroxides coated on the colorant particles is used to solve the problem. No transfer of composite images is disclosed in these references.

Many methods are used to aid the efficient transfer of toner from a photoconductor surface after toner development to a receptor sheet. U.S. Pat. No. 3,157,546 discloses overcoating a developed toner image while it is still on the photoconductor. A liquid layer having a concentration of about 5% of a film-forming material in a solvent is used at between 10 and 50 microns wet thickness. After drying, transfer is carried out to a receptor surface which has a mildly adhesive surface. Defensive Publication T879,009 discloses a liquid toner image first developed on a photoconductor and then transferred to a receptor sheet whose surface is coated with a polymer layer easily softenable by residual solvent in the developed image which thus adheres the image to the receptor surface. U.S. Pat. No. 4,066,802 discloses the transfer of a multitoned image from a photoconductor, first to an adhesive carrier sheet, and then to a receptor. The second stage involves the application of heat and pressure with a "polymeric or plasticizing sheet" between the image on the carrier sheet and the receptor surface. U.S. Pat. No. 4,064,285 also uses an intermediate carrier sheet which has a double coating on it comprising a silicone release layer underneath and a top layer which transfers to the final receptor with the multicolor image and fixes it under the influence of heat and pressure. U.S. Pat. No. 4,337,303 discloses methods of transferring a thick (high optical density) toned image from a photoconductor to a receptor. High resolution levels of the transferred images are claimed (200 l/mm). It is required to dry the liquid toned image and encapsulate the image in a layer coated on the receptor. Curing of the encapsulating layer is required with some formulations. The materials of this layer are chosen to have explicit physical properties which provide not only complete transfer of the thick toner image but also ensure encapsulation of it.

U.S. Pat. No. 4,477,548 teaches the use of a protective coating over toner images. The coating is placed on the final image and is not involved in any image transfer step. The coating may be a multifunctional acrylate, for example.

Transfer of certain types of composite multitoned images is disclosed in the art. U.S. Pat. No. 3,140,175 deposits microbeads containing a dye and a photoconductor on one electrode, exposes them through a colored original and then applies field between a first and second electrode causing separation of charged and uncharged beads and transfer of the colored image to a receptor surface at the second electrode. U.S. Pat. No. 3,376,133 discloses laying down different colored toners sequentially on a photoconductor which is charged only once. The toners have the same charge as that on the photoconductor and replace the charge conducted away in image areas. However, it is disclosed that subsequent toners will not deposit over earlier ones. The final image of several toners is transferred to a receptor and fixed. U.S. Pat. No. 3,862,848 discloses normal sequential color separation toned images transferred to an intermediate receptor (which can be a roller) by "contact and directional electrostatic field" to give a composite multitoned image. This composite image is then transferred to a final receptor sheet by contact and a directional electrostatic field.

U.S. Pat. No. 4,600,669 describes an electrophotographic proofing element and process in which successive liquid toned color images are formed on a temporary photoconductive support. The composite image is then transferred to a receptor layer. The photoconductive layer has a releaseable dielectric support coated thereon which may comprise a polymeric overcoat on the photoconductive layer which is transferred with the composite image.

U.S. Pat. No. 4,515,882 describes an electrophotographic imaging system using a member comprising at least one photoconductive layer and an overcoating layer comprising a film forming continuous phase of charge transport molecules and charge injections enabling particles.

U.S. Pat. No. 4,565,760 describes a photoresponsive imaging member comprising a photoconductor layer and, as a release protective coating over at least one surface, a dispersion of colloidal silica and a hydroxylated silsesquixone in alcohol medium.

U.S. Pat. No. 4,600,673 describes the use of silicone release coatings on photoconductive surface to increase the efficiency of toner transfer in electrophotographic imaging processes.

U.S. Pat. No. 4,721,663 describes an improved enhancement layer used in electrophotographic devices between a top protective layer and the photoconductor layer.

U.S. Pat. No. 4,752,549 describes an electrophotographic receptor having a protective layer consisting of a thermosetting silicone resin and a polyvinyl acetate resin. The combination provides improved densability.

U.S. Pat. No. 4,510,223 describes a multicolor electrophotographic imaging process. A general description of transfer of the toned image to an adhesive receptor is disclosed (column 15, lines 21–40).

SUMMARY OF THE INVENTION

Images are formed by charging and toning of at least one electrostatic image on a temporary image sheet. Successive charging, imaging and toning may be performed. Preferably, but not essentially, each toning is effected with a toner absorbing radiation in a different portion of the electromagnetic spectrum than toner used in any other toning step, forming a composite image comprising at least two toners on said temporary image sheet, contacting said composite image with a temporary receptor sheet pressing said composite image against said temporary receptor sheet with sufficient pressure to transfer said toner, releasing said pressure, and contacting said toner image said temporary receptor sheet with a permanent receptor surface, and transferring said toner image from said temporary receptor sheet to said permanent receptor. The same toner may be used in these sequences to provide a composite of information on a single sheet, or the toners may differ in their mechanically readable properties by other than color differences. For example, the toners may absorb differing wavelengths of radiation outside the visible spectrum. Magnetic properties, luminescence and conductivity differences may also provide the basis for mechanically differentiable properties that can be read.

The temporary receptor surface must comprise at least a support layer having on at least one surface thereof two layers. The composite toner image (at least one and preferably at least two toners containing image) is first transferred onto said releaseable transfer layers. The transfer layers with the composite toner image is then transferred to a receptor surface. The transferable layers comprise in sequence from the support layer, a release layer in contact with said support layer and an adhesive layer in contact with said release layer. The release layer transfers with said adhesive layer and can act as a top protective layer on the transferred image. The release layer is a clear (i.e., transparent) polymeric layer.

The image of at least two toners on the temporary image sheet may be contacted with the adhesive layer in a number of ways. For example, the adhesive may already exist as a surface layer on the temporary receptor sheet and the toner image is brought into contact with that surface layer. The binder may also be applied as a separate layer on the toner image (e.g., by coating from a liquid composition). A film of the binder may also be laid over the toner image or between the toner image and the temporary receptor sheet.

A temporary composite multicolored image is produced on the photoconductor having a release surface by overlaying on a primary imaging surface a succession of liquid toned images of differing colors produced by separate charging, exposing and toning procedures. The primary imaging surface may be a photoconductor addressed with an optical image or a charge retaining surface addressed with electrical styli. The entire composite toned image is transferred to a temporary receptor sheet by techniques which result in the toner particles being firmly adhered to a transparent binder yet retaining the high color quality and resolution stemming from the liquid toners used.

The overlay of several toner images (commonly 3 or 4) results in a thick composite of toners in certain areas and little toner in others (sometimes toners are even adjacent to each other, but are not attached as in half tones) so that the adherent procedure must be able to accommodate thick toner layers. The adhesive materials are chosen with physical properties explicity suitable to this purpose. The general process may be described as:

A) The composite toner layer on the primary imaging surface is contacted with an adhesive layer of a film-forming transparent binder adhered to a transparent release layer on a carrier layer surface. After drying or cooling, this binder layer is contacted with a permanent receptor sheet to which it transfers along with the release layer when pressure and preferably heat is used. The primary imaging surface is optionally, but need not be, advantageously coated with a silicone release layer to ensure complete release of the toner, but choice of the photoconductive material can also ensure the required complete release. For example, the photoconductor itself may have a highly releaseable surface, and the properties of toners with respect to the surface may be chosen for high release properties.

Particularly in cases where heat and pressure transfer is used, no further fixing of the transferred image is required. Transferred images are of high gloss and show good color purity, high resolution, and high maximum density capability. The process also provides significant protection against abrasion and chemical contamination of the image. The natural release properties of the top protective layer also provides excellent anti-blocking properties to the final image.

It is one aspect of the invention to provide a method of complete transfer of a toned image or a multitoned image from an electrographic image surface to a temporary receptor surface and then to a final receptor surface.

The invention finds special utility in a wide range of applications where multicolored toner images are assembled by overlaying on an electrographic surface. Examples are color proofing for the printing industry, colored map making and colored overhead transparencies.

DETAILED DESCRIPTION OF THE INVENTION

An electrophotographic imaging process is performed by a definite sequence of steps which comprise:

1) providing a photoconductive layer (preferably with an abhesive layer or surface, such as a release layer or release surface) having an imaging surface, 2) charging said imaging surface of said photoconductive layer, 3) discharging in an imagewise fashion the charge on said imaging surface, 4) toning the imagewise charge remaining on said imaging surface with a first color toner, 5) optionally repeating steps 2, 3 and 4 at least one more time (the use of four colors, total being the most preferred but fewer or more colors are useful) using different color toners each time (different from said first color and each successive color) to form a multitoned image, 6) contacting said image (preferably multitoned image) with a transfer web (intermediate receptor layer) comprising in sequence, a carrier layer, a transferable release layer, and a releasable adhesive layer (releasable from the carrier layer along with the transferable release layer so that both layers transfer at once), said adhesive layer being in contact with said toned image, said contacting being done under sufficient heat and/or pressure to enable said toned image to be adhered to said releasable adhesive layer with greater strength than the adherence of said toned image to said imaging surface of said photoconductive layer, 7) separating said transfer web and said photoconductive layer so that the toned image is removed from said photoconductive layer and remains adhered to the adhesive layer of the transfer web, 8) contacting the surface of the transfer web having both the multitoned image and adhesive thereon with a permanent receptor surface, 9) adhering the adhesive on the transfer web to the permanent surface, 10) removing the carrier layer of the transfer web from the adhesive and the release layer of the transfer web so that an image article is formed of the permanent receptor, multitoned image, releaseable adhesive, and the resultant surface coating of the release layer which is furthest away from the permanent receptor.

When this process has been performed, the imaged article is useful in its existing form or may be further modified. Because there is a protective adhesive layer and release layer on the outer surface, the article may be further modified without affecting the substantive aspects of the image itself. For example, the surface may be lightly embossed to be deglossed, particles may be pressed into the surface for matting or slip properties, and additional imaging may be applied to the surface. Because the toner is directly against the permanent receptor surface with little or no adhesive between them, reduced dot gain is exhibited in the final image on paper or other reflective substrates.

The invention provides a method for the efficient and complete transfer of a toned or multitoned image from an electrographic imaging surface to a receptor surface.

The term multitoned image means an image formed by successive overlaying of two or more toners which are differentially readable by mechanical means, using for example, light absorption, UV or IR absorption, magnetic properties, conductivity, luminescence, etc. For a preferred embodiment, the toners are distinguishable from one another by color differences. The term color is inclusive of radiation within 200 nm of the visible portion of the spectrum which can be mechanically distinguished. This includes the near infrared and near ultraviolet. The embodiment uses three or four toners for the color reproduction of natural color scenes, but the transfer of two or more color content images are contemplated in the practice of the present invention.

The invention relates to a method of transferring multitoned images from an electrographic surface to a receptor surface by adhering the image to a releaseable bilayer of both the transferable adhesive and transferable release layer surface on a temporary receptor layer of a film-forming binder which is substantially transparent to visible light or to other radiation (near UV, near IR) which may be used to read the final image.

The electrographic surface may be a photoconductor or a dielectric surface suitable for receiving and retaining charge (e.g., from an electrostatic stylus). Photoconductors may be chosen from inorganic types such as selenium and its alloys, zinc oxide and lead oxide dispersions, cadmium sulfide to antimony sulfide or from organic materials such as phthalocyanine pigments, polyvinyl carbazoles, and particularly bis-benzocarbazolyl phenylmethane as disclosed in U.S. Pat. No. 4,361,637. Particularly in the case of photoconductors, these surfaces may be colored or opaque. Even organic photoconductors may have a substantial color. Such colored materials are unsuitable as the final image carrying surface particularly when natural colored images are required. Transfer of the images to a suitable final or permanent receptor surface such as paper, clear plastic, light diffusing plastic, glass, polymer coated paper, metal, etc. is therefore important to the final quality of the image.

Apart from its film-forming and transparent properties, the adhesive binder forming the transferable adhesive layer on the release layer on the temporary receptor should have the following properties:

a) releasable from the electrographic surface under heat/pressure b) adhesive to the receptor surface under heat/pressure c) should adhere to the toner particles of the image under heat/pressure without disturbing the image d) should have the appropriate thickness and flow properties under useful transfer conditions (e.g., between 30° and 200° C. at 300 to 5000 g/cm$^2$) to allow the adhesive to flow over and around the dried toner image so as to assure its adherence to the adhesive layer. The range of properties that can be controlled and which should be considered in the construction of articles and the performance of the process include, but are not limited to:

Adhesive Layer

Thickness
Tg
Melt Index
Melt Viscosity
Optical Clarity
Adhesion to Protective Layer
Wettability to toner deposit and paper
Plasticization of toner layer
Flow after transfer Release Layer (Protective Layer)

Thickness
Tg
Optical Clarity
Scratch Resistance
Relative release from Carrier Sheet
Coatability by Adhesive Layer
Embossing Characteristics
Ability to separate at start and end of image from web
Release properties from Carrier Layer Carrier Sheet Thickness
Flexibility
Transparency
Surface Roughness Releasability Transfer Conditions Temperature
Pressure
Roller Durometer
Contact Angle
Separation Angle
Speed
Transfer to final substrate conditions

ALTERNATIVES, SUBSTITUTES, EQUIVALENTS

The actual materials used in the examples provide the balance of these properties which enable practice of the present invention.

Advantageous properties for the adhesive binder and release layer include a glossy finish after transfer, and capability to receive an embossed surface finish, both of which are aided by thermoplastic properties.

In the preferred embodiment, liquid toned multitoned images are used because of their high resolution and good tone gradation. Liquid toners can have very small particle sizes ($\leqq 1$ micrometer) and the adhering of such small particles without disturbing the image puts high demands on the binder.

Examples of binder/solvent systems suitable for use as the adhesive on the temporary receptor are acrylic resin dispersions in cycloaliphatic solvents, e.g., cyclohexane, low and medium molecular weight epoxy resins (e.g., in methyl ethyl ketone), and low and medium molecular weight polyesters. Other possible adhesives are those described in U.S. Pat. No. 4,337,303.

Examples of possible release layers (chosen to be acceptable with the various adhesive binder layers) include poly(vinylacetals) (especially polyvinyl butyrals), polyvinyl alcohol, polyamides (especially nylons such as nylon 8061, 8063 and 8066), etc.

In both modes of practice of the invention, the dry thickness of the adhesive on the temporary receptor layer should be in the range 3 micrometers to 100 micrometers and preferably in the range 10 micrometers to 50 micrometers. If the layer is too thin, it cannot effectively flow over the thick composite layers of toners, and loss of toner in the image results. With the correct choice of layer thickness and material the transferred image can retain resolving power levels up to 200 l/mm or more.

Liquid toners are well known in the art. To varying degrees, all liquid toners can be used. As is known in the art, the charge pattern for each previous toner image should be discharged prior to laying down a charge pattern for the next toner image. Because the toner images tend to be very thin, this is usually easily accomplished even through the toner itself. It can be relatively conductive as the conductivity of the toner will enable easier discharge through the image.

Drying of the applied liquid toner image provides significant advantages to the process. The actual process step of drying may, however, cover a range of degrees of removal of liquid carrier from the applied toner image. As toner compositions vary significantly in their components, there is no single operative characterization that can be made to describe the optimum drying conditions or the optimum degree of drying. Some general remarks can be made on the subject however.

It is generally better to remove more liquid components from the liquid toner during the drying process than to effect only incidental drying. That is, whatever the percentage of liquid in the toner as applied to the substrate, the greater the percentage of liquid removed, the better the effects upon the imaging process. For example, different deposited toner images may comprise from 90-10% liquid carrier when applied. Different percentages of this liquid should be removed in order to optimize drying. In some instances removal of at least 75% of the carrier liquid may be sufficient. In other toners, removal of more than 95% of the liquid must be effected. Generally then, at least 75% of the carrier liquid should be removed before application of pressure and/or heat. Preferably at least 85%, more preferably at least 95%, and most preferably approximately 100% (greater than 99%) of all original carrier liquid should be removed during the drying process. A range of 75 to 100% of the liquid is generally removed prior to application of pressure, usually 85-100%, more preferably 95-100%.

A few physical procedures can be performed to assist in determining optimum drying conditions. For example, one test which is used is to first dry the applied toner, then apply a clear liquid (consisting of the liquid used as the carrier in the toner) and then quickly apply shear force to the dried image, e.g., resulting from flow of the liquid over the dried image at a speed of 5 cm/sec. If the image of a 1 mm dot is smeared or distorted to increase its dimension in the direction of shear by more than 2%, then it is less than optimally dried. The test must be run with a minimum dwell time of the clear liquid on the dried image, as for example about 5 seconds or less.

Some liquid toners change their reflective characteristics during drying. For example, when applied and during drying, the liquid toner image remains highly reflective. Once optimum drying has been achieved, the image has a matte appearance. Reflectivity is reduced by at least 25% and some times by at least 40% in this optical change during drying. This evaluative technique tends to be dependent upon the individual characteristics of the toner and is not universal to all toners.

The temperature of transfer according to the process of the present invention is defined as a temperature below 200° C. or below 180° C. It is preferred that the transfer process occurs at temperatures up to only 130° C. (above which temperature typical support materials, e.g., polyester films, tend to soften and deform); it is most preferred that the range of 30°-120° C. be used as the surface temperature for the heated adhesive, both to conserve energy and to limit the extremes of temperature to which the receptor or photoreceptor, on which the image is originally developed, is subjected. Amorphous selenium, a photoconductor of choice for many applications, crystallizes when heated above 65° C., thereby forfeiting its photoconductive properties. Other useful photoconductors, such as amorphous chalcogenides, or dispersions of inorganic pigments, such as lead oxide, are also damaged when subjected to high pressures, as is necessary in some toner transfer techniques of the prior art. For example, transfer of toner to a thermoplastic receptor by the adhesive mechanism requires typically the application of pressure of 50 to 150 $kg/cm^2$; similar forces are required for the pressure fusing of dry toner deposits. On the other hand, in carrying out the process of the present invention, the toner is adhered on application of, typically, 0.3 to 5 $kg/cm^2$ although a pressure range of 0.1 to 50 kg/cm$^2$ may be used. Generally a range of 0.1 to 20 kg/cm$^2$ is preferred.

The invention will now be illustrated by the following examples.

EXAMPLE 1

Protective Layer

Coating Solution

Methanol solvent: 55.8 pts. by wt.
n-Propanol solvent: 37.2 pts. by wt.
Butvar B-73 (polyvinyl butyral) resin: 7.0 pts. by wt.

This solution is coated on 2 mil polyester (PET) base and dried to remove the solvents. A coating weight range of 0.54 to 5.4 g/m$^2$ is preferred. Higher coating weights are more flexible, and are more desirable in sheet fed operations where handling characteristics are important.

The choice of polymer and the coating weight used for the adhesive layer will influence the desired weight of the protective layer.

Adhesive Layer

Coating Solution

Methyl Ethyl Ketone solvent: 70.0 pts by wt.
Epon 1007 resin: 18.9 pts by wt.
Epon 828 resin: 11.1 pts by wt.

This is coated on top of the above protective layer and dried to remove the solvent. A coating weight range of 1.62 to 21.6 g/m$^2$ is preferred. Lower coating weights have greater flexibility but poorer adhesion to rough surfaces. Removal of toner images also suffers. However, visual effects on the transferred image decrease with decreasing overall coating weight of the combined layers. Higher coating weights, of course, result in the converse of the effects noted above.

As previously described, the above coated films are useful to transfer and fix toner images from photoconductive surfaces. It is particularly useful when it is desired to transfer multiple layers of half-tone images at one time as in four color proofing, which helps to minimize registration problems. With half-tone images one must contact each individual dot and screen area in order to transfer it. With four color images, a greater degree of relief is built up as each color is applied to the imaging surface. It is not uncommon to find portions of the first image lying adjacent to areas which have several layers built up from succeeding imaging steps. A high quality proofing system must be able to retain this information and therefore it is imperative that the transfer medium be able to conform to these irregularities and contact essentially all portions of the exposed layers. With half-tone images, all isolated dots must be contacted or they will not transfer from the imaging plane. This will greatly reduce the value of not only this proof but since some of the remaining image will probably transfer to the next proof, its value will be affected also.

Materials that are particularly useful are those that exhibit low viscosity melt characteristics which permit the thermoplastic resin to flow readily around and into the microstructure associated with four color half-tone proofs. While to some degree, this can be accomplished with many resins if there are no temperature restrictions, in actuality, the thermal stability of the coating base and other practical considerations lead one toward minimizing the thermal input required to accomplish this. The construction described above requires that the adhesive reach approximately 90° C. in order to insure complete removal of four color half-tone images. It is well known that the Melt viscosity of a polymer increases exponentially with its molecular weight (power law). The preferred materials therefore are low molecular weight polymers which are solid and non-tacky at room temperature but become 'fluid' at elevated temperatures. These materials are not normally considered good thermal adhesives since the upper usable thermal limit is considerably below that desired for wide commercial use as a thermal adhesive. Conventional thermal adhesives however, would require transfer temperatures far in excess of 90° C. and result in far greater thermal distortion if they were used for toner transfer.

Examples of suitable polymers are the low molecular weight epoxy resins made by the condensation of epichlorohydrin and Bisphenol A such as those marketed by Shell Chemical Co. under the trade name of Epon, and the Bisphenol A—fumerate polyesters marketed by Reichhold under the trade name of Atlac. By using a mixture of two resins, one a higher molecular weight solid and the other a low molecular weight liquid one can by varying the ratios, control the softening point and thus optimize the ambient storage stability and the critical temperature needed for transfer of toner images. This can be done in a predictable manner within a resin system by blending to the desired Tg (glass transition temperature). The Tg of the blend can be calculated from the experimentally determined Tg's of the individual resins by the following relationship. 1/Tg blend = - weight fraction of resin A/Tg resin A + weight fraction of resin B/Tg resin B . . . where the Tg is in degrees K. As the Tg of the blend increases, the Tm of melt temperature will also increase thus requiring higher temperatures during toner transfer and conversely as the Tg decreases, the temperature required for toner transfer will decrease. Within a resin system, i.e. polyester or epoxy, and at the molecular weights suitable to obtain complete transfer of the toner, the relationship between Tg and Tm is fairly linear so that a 5° C. increase in Tg will result in approximately a 5° C. increase in the temperature required for transfer. However, the temperature required for transfer of the toner image is only related to the Tg of a resin insofar as it relates to the Tm and melt viscosity of that polymer. This relationship must be determined for each type of polymer system used since the melt viscosity of a polymer will depend on its structure and molecular entanglements as well as its molecular weight. The use of a liquid for the lower molecular weight portion of the resin blend is particularly useful in that the presence of the liquid acts as a plasticizer and aids in the uncoiling of the entanglements thus further reducing the viscosity of the melt.

The transfer of the toner image which is now on the thermal adhesive layer of the transfer web, to another substrate such as paper does not require as high a thermal input, indicating that the governing factor in this operation is one more of surface tack and uniform contact. However, as the surface roughness of the substrate increases, the importance of viscoelastic flow again becomes important since if the lamination is not complete and air is trapped in the pores of the substrate, visual acceptability of the proof decreases.

EXAMPLE 2

This example was performed using the apparatus and procedures described in U.S. Pat. No. 4,728,983 as follows.

A metal drum of diameter 20 cm and length 36 cm rotated on journals supported on a substantial frame (not shown) driven by a DC servo motor with encoder and tachometer controlled in speed to 0.42 revolutions per minute by a speed controller. A layer of photoconductor coated on a plastic substrate having an electrically conductive surface layer, was wrapped around the drum, fixed firmly to it, and grounded. Over the layer of photoconductor was a polydimethylsiloxane release layer as taught in U.S. Pat. No. 4,600,643. The photoconductor comprised bis-5,5'(N-ethylbenzo(a)-carbazolyl)-phenylmethane in a Vitel PE207 binder, sensitized with an indolenine dye having a peak absorption in solution at a wavelength of 787 nm. Infrared light of power 2 mw and wavelength 780 nm emitted by a self-modulated laser diode was focused by a lens system onto the photoconductor surface as a spot with ½ Imax diameter of about 30 microns. The focused beam, modulated by signals supplied from a memory unit by a control unit to a laser diode, was directed to a rotating two-surface mirror driven by a motor. The mirror speed of 5600 revolutions per minute and the synchronization of its scans with the image signals to the laser diode were controlled accurately by the control unit. The sensor supplied to the control unit signals for the start of a cycle of rotation of the drum. The signals were used to commence a signal to the laser diode for the beginning of picture frame information.

The scorotron charged the surface of the photoconductor to a voltage of about +700 V immediately before the exposure point. The toning developer unit contained three identical units containing respectively cyan, magenta, and yellow liquid toner. In each unit there were means to supply the toner to the surface of a roller which was driven at the same surface speed as the drum. Motor means enabled each separately desired toner station to be selected to engage the roller with the surface of the photoconductor so that toner was applied to the surface.

Means were provided to apply a bias voltage of +350 V between the roller and the electrically conducting layer. Vacuum means was provided in each unit to remove excess liquid toner at a point immediately downstream of the roller. Drying means was provided downstream of the vacuum means. The complete cycle was repeated for each of the required color separation images. Three individual color images were laid down in register in the order cyan, magenta and yellow.

The photoreceptor layer was positively charged, exposed to a suitable imaging light, and developed, sequentially with a Panacopy PAKU-SSTK yellow, cyan, and magenta liquid toners, designed here Y-1, C-1, and M-1 respectively, to give a full color image on the photoreceptor.

Y-1 azo pigment CI 21105 was in a polymethacrylate binder.

C-1 Phthalocyanine pigment CI 74160 was in a polyester binder.

M-1 Pigment CI 4516:1 was in a hydrogenated rosin binder.

A transfer web comprising coating the Butvar TM protective layer (as shown in Example 1) onto 2 mil (0.05 mm) polyethyleneterephthalate at a coating weight of 3 g/m$^2$. Over this layer the epoxy adhesive layer (Example 1) was coated at 15 g/m$^2$.

The three color image was transferred to this receptor construction by the actuating drive roller (as shown in U.S. Pat. No. 4,728,983) heated to 150° C. and engaging the transfer web surface with the photoconductor surface at a pressure of 1.0 kg/cm and transferring at a rate of 38 cm/min. After separating the transfer web from the photoconductor with the three color image, no residual toner was found remaining on the photoconductor. This transfer web with the three color toned image was then laminated against Matchprint TM Commercial Base paper with the same temperature and pressure conditions and a transfer speed of 200 cm/sec. The carrier sheet was then removed.

What is claimed is:

1. A process for electrographic multitoned image transfer comprising the steps of a) producing on the surface of an electrographic element a liquid toned image, b) contacting said image on said surface with a temporary receptor element comprising in sequence a carrier layer, a release layer and a thermoplastic film-forming binder, said binder having a dry thickness in the range of 3 to 100 micrometers, c) applying between said electrographic element and said binder on said receptor element a pressure of between 0.1 kg/cm$^2$ and 50 kg/cm$^2$ at a temperature in the range of 30° C. to 200° C., d) releasing the pressure, and e) separating said receptor element from said one surface of said electrographic element, said liquid toned image remaining adhered to said binder on said carrier element, f) contacting said liquid toner image and said binder to a permanent receptor layer under conditions of heat and/or pressure sufficient to adhere said binder to said permanent receptor with a bond strength that exceeds the binders adherent strength to said carrier layer, and g) removing said carrier layer so that said toner image, binder layer and release layer are adhered to said permanent receptor, with said release layer being furthest away from said permanent receptor.

2. A process as recited in claim 1 wherein said pressure in step f) is between 0.3 kg/cm$^2$ and 5 kg/cm$^2$.

3. A process as recited in claim 1 wherein said one surface of said electrographic element comprises a photoconductive element which comprises a thin release layer of a film-forming silicone.

4. A process as recited in claim 1 wherein said thermoplastic film-forming binder is chosen from the group consisting of acrylic resin dispersions, epoxy resins, and polyamide resins.

5. A process as recited in claim 1 wherein said permanent receptor surface comprises one of two major surfaces of a support sheet comprising paper, clear plastic, light diffusing plastic, glass, or opaque plastic.

6. A process as recited in claim 1 wherein the material of said thermoplastic film-forming binder is chosen from the group consisting of photo-cured epoxy oligomers.

7. The process of claim 1 wherein said liquid tone image is a multicolor liquid toned image.

8. The process of claim 2 wherein said liquid tone image is a multicolor liquid toned image.

9. The process of claim 3 wherein said liquid tone image is a multicolor liquid toned image.

10. The process of claim 4 wherein said liquid tone image is a multicolor liquid toned image.

11. A process as recited in claim 2 wherein said one surface of said electrographic element comprises a thin release layer of a film-forming silicone.

12. A process as recited in claim 6 wherein said one surface of said electrographic element comprises a thin release layer of a film-forming silicone.

13. A process as recited in claim 7 wherein said one surface of said electrographic element comprises a thin release layer of a film-forming silicone.

14. The process of claim 1 wherein said release layer comprises polyvinylbutyral.

15. The process of claim 2 wherein said release layer comprises polyvinylbutyral.

16. The process of claim 3 wherein said release layer comprises polyvinylbutyral.

17. The process of claim 4 wherein said release layer comprises polyvinylbutyral.

18. The process of claim 10 wherein said release layer comprises polyvinylbutyral.

19. The process of claim 11 wherein said release layer comprises polyvinylbutyral.

20. The process of claim 12 wherein said release layer comprises polyvinylbutyral.

* * * * *